United States Patent [19]

Bishop

[11] 4,383,685

[45] May 17, 1983

[54] TRAINING AID FOR BASKETBALL PLAYERS

[76] Inventor: Leonard E. Bishop, 638 Yorktown Dr., Garland, Tex. 75043

[21] Appl. No.: 340,365

[22] Filed: Jan. 18, 1982

[51] Int. Cl.[3] ..... A63B 69/00

[52] U.S. Cl. ..... 273/1.5 A

[58] Field of Search ..... 273/1.5 A, 54 B, 54 BA, 273/189 R, 189 A

[56] References Cited

U.S. PATENT DOCUMENTS

| | | | |
|---|---|---|---|
| 2,773,691 | 12/1956 | Redfield | 273/189 R |
| 3,000,633 | 9/1961 | Bonovich | 273/54 B |
| 3,400,934 | 9/1968 | Muehl | 273/189 A |
| 3,419,277 | 12/1968 | Martin | 273/189 R |
| 3,820,783 | 6/1974 | Caveness | 273/1.5 A |
| 4,017,086 | 4/1977 | Washburn | 273/189 R X |

*Primary Examiner*—Paul E. Shapiro

*Attorney, Agent, or Firm*—Munson H. Lane, Jr.

[57] ABSTRACT

A training aid for basketball players comprises a vest worn by the player, a curved guide bar pivotally mounted on the vest by a selected one of a pair of pivot studs extending outwardly from opposite sides of the vest, an elastic sleeve worn over the elbow of the player on the same side of the player as the guide bar, and a carriage assembly which is secured to the elastic sleeve and which is guided by the guide bar to move in a curved path when the player lifts his arm to throw a basketball, the player's arm thereby being guided in a desired path for the proper throw of the basketball. The training aid is adaptable for right or left-handed players by positioning the guide bar selectively on the right or left-hand side of the player and by placing the elbow sleeve and carriage assembly on same side of the player as the guide bar.

20 Claims, 6 Drawing Figures

TRAINING AID FOR BASKETBALL PLAYERS

FIELD OF THE INVENTION

This invention relates to a training aid for basketball players and more particularly to a training device worn by a basketball player to aid the player in developing a good basketball shot, and more especially to a training device worn by the basketball player to develop an arm motion during the basketball shooting in which the elbow is moved only in a straight up and down direction which is the proper way for shooting.

STATEMENT OF THE PRIOR ART

U.S. Pat. No. 3,820,783, issued to Gerald W. Caveness on June 28, 1974, shows a basketball training aid carried by the player and which indicates the height to which the player's elbow should be raised before extending the forearm to shoot a basket. However, the device of the U.S. patent just mentioned is quite different in its construction and in its operation from that of the present invention.

STATEMENT OF THE INVENTION

Accordingly, it is an object of the present invention to provide a training aid for basketball players which is worn by the player and which serves to train the player to keep his elbow straight and to ensure that the elbow of the player is moved only in a straight up and down direction which is the proper way for shooting a basket in the game of basketball.

It is a further object of the invention to provide a training aid or "shot developer" for use by basketball players which assists the player in developing the proper technique for making basketball shots by training the player to develop the proper elbow motion in raising the arm to the position in which the player's forearm is extended to project the ball forwardly.

It is a further object of the invention to provide a basketball training aid which is adapted to be worn by the player and which is light in weight and requires very little energy to carry whether or not the device is mounted on the player.

Accordingly, it is an object of the present invention to provide a training device adapted to be worn by a basketball player to develop in the player proper movement of the elbow in a straight up and down direction, which is the proper way for shooting baskets in basketball.

It is another object of the invention to provide a training device for basketball players which is easy to handle and requires very little energy to carry the device whether or not it is being worn by the player.

It is a further object of the invention to provide a training device of the hereinbefore described type for use by basketball players which is worn by the player and which is adapted for use by either a right-hand or by a left-hand player.

In achievement of these objectives there is provided in accordance with the invention a training aid for use by basketball players, to aid the player in developing a good basketball shot comprising a vest-like member adapted to be worn by the player, an arcuate guide bar for guiding the elbow region of the player's arm for movement in a substantially vertical plane, support means carried by said vest-like member for supporting said guide bar for pivotal movement in a substantially vertical plane about an axis located contiguous the normally lower end of said guide bar, said guide bar being pivotally mounted on said support means, a sleeve member adapted to be worn by the player contiguous the elbow region of the player, and means connected to said sleeve member and slidably engageable with said guide bar, whereby to constrain said sleeve member and thus the player's elbow to move in a substantially vertical path of movement substantially parallel to the plane of said guide bar.

Further objects and advantages of the invention will become apparent from the following description taken in conjunction with the accompanying drawings in which:

DESCRIPTION OF THE PREFERRED EMBODIMENTS

Figure 3:
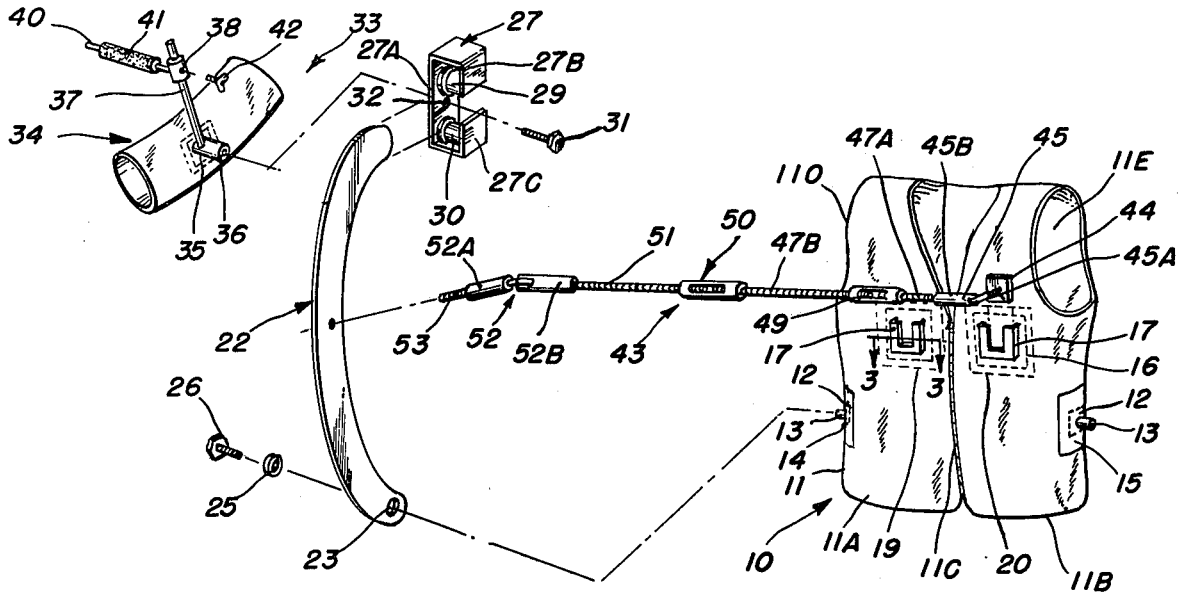
FIG. 3 is an exploded view of one embodiment of the shot developer device of the invention with the elements of the shot developer positioned for use by a right-hand basketball player.

Referring now to the drawings, the shot developer device for use in training basketball players in accordance with the invention is generally indicated at 10 in FIG. 3 and comprises a vest member generally indicated at 11 which is adapted to be worn by the player and which may be made of any suitable material. Vest 11 includes right-hand and left-hand front panels respectively indicated at 11A and at 11B which are adapted to be closed by a zipper 11C. In the illustrated embodiment shown in the drawings, vest member 11 is provided with opposite openings 11D and 11E through which the player's arms pass.

As best seen in FIG. 3, each of the opposite lateral sides of vest 11 is provided with a corresponding pocket-like member respectively indicated at 14 and 15 for the right-hand and left-hand side of the vest, as viewed by the player. Each of the respective pocket-like members 14, 15 is adapted to retain a base portion each respectively indicated at 12 which lies inwardly of the corresponding pocket 14, 15, and a stud member each respectively indicated at 13 is supported by each of the respective base portions 12, each stud member projecting outwardly beyond the outer surface of the corresponding pocket 14, 15 to serve as a mounting means for an arcuate guide bar generally indicated at 22. Guide bar 22 may be made of a suitable metal or of other suitable material. Guide bar 22 may be selectively mounted on the pivot stud 13 corresponding to pocket 14 for a right-hand player, or, conversely, guide bar 22 may be instead mounted on the pivot stud 13 corresponding to the pocket 15 for a left-hand basketball player.

Figure 2:
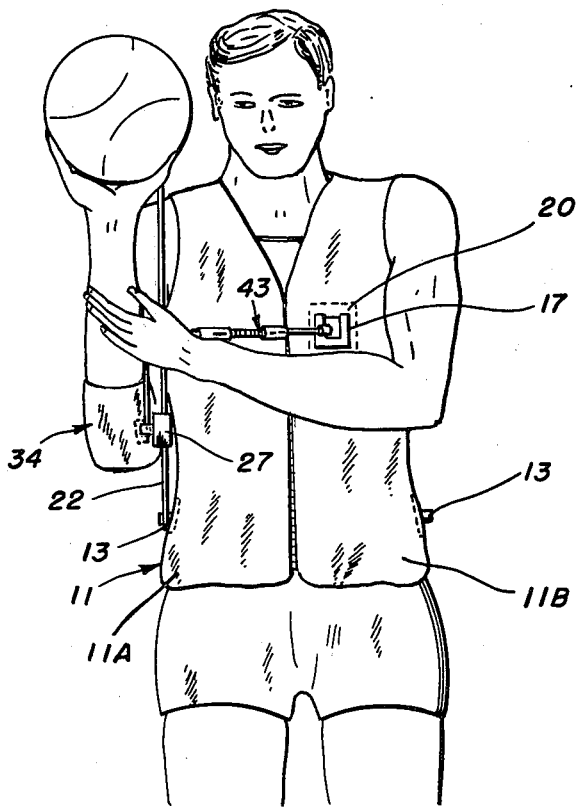
FIG. 2 is a view of the basketball player of FIG. 1 with his arm lowered and before raising the arm to the FIG. 1 position.

As previously mentioned, the embodiment shown in FIG. 3 of the drawings has the various elements thereof arranged for use by a basketball player who is right-handed which requires that guide bar 22 be mounted on the pivot stud 13 on the right-hand side of the vest. Arcuate guide bar 22 is provided at the lower end thereof relative of the view shown in FIG. 3 with an aperture 23 which receives a screw member 26. A washer 25 is interposed between the lower end of guide bar 22 contiguous the pivot aperture 23 and the head of screw 26. In assembling guide bar 22 onto pivot stud 13 corresponding to pocket 14 in the view of FIG. 3, the screw 26 with the washer 25 positioned thereon is passed through the aperture 23 at the lower end of guide bar 22 and is received in an internally threaded passage in stud 13 whereby to pivotally mount the lower end of guide bar 22 on pivot stud 13. The mounting of arcuate guide bar 22 on pivot stud 13 as just described permits guide bar to pivot about the axis of stud 13 as may be required during the arm motion of the player wearing vest 11, and also permits guide bar 22 to adjust to players having different arm lengths. When guide bar 22 is mounted on stud 13 as best seen in the view of FIG. 2, the guide bar lies in a plane substantially parallel to the upper trunk portion of the player's body.

Cooperating with guide bar 22 in the embodiment of FIG. 3 is a player arm support subassembly generally indicated at 33 and comprising a carriage generally indicated at 27 and a sleeve generally indicated at 34. Sleeve 34 is made of a suitable elastic fiber or the like. As best seen in views of FIGS. 1 and 2, sleeve 34 is worn by the player on his arm and is so positioned on the player's arm that sleeve 34 is substantially symmetrically located with respect to the elbow of the player with one portion of the sleeve as indicated at 34A lying in the upper portion of the arm above the elbow while the other portion indicated at 34B in the view of FIG. 1 lies on the forearm of the player.

As best seen in the view of FIG. 3, the carriage generally indicated at 27 includes a web portion 27A and two oppositely disposed L-shaped portions respectively indicated at 27B and at 27C lying at opposite ends of web portion 27A. Carriage 27 includes an upper roller 29 which is supported for rolling action between web portion 27A and L-shaped carriage portion 27B, and a lower roller 30 supported between the lower end of web portion 27A and L-shaped carriage portion 27C. Carriage 27 is adapted to be received in rolling engagement with arcuate guide bar 22, the guide bar 22 being received between upper and lower rollers 29, 30 of carriage 27.

Sleeve members 34 which is worn by the player on his arm is adapted to be carried by and move with carriage 27 and for this purpose, sleeve 34 is provided in the portion thereof which is directed toward guide bar 22 with a pivot stud 36 which is suitably secured to a plate member 35 which is suitably secured to the wall of sleeve 34 at a centrally located portion of sleeve 34 facing guide bar 22. Pivot stud 36 is provided with an outwardly opening internally threaded passage which is adapted to receive a screw member 31 whereby when screw 31 passes through aperture 32 in web portion 27A of carriage 27 and into the internally threaded passage of pivot stud 36, carriage 27 and the sleeve 34 are then secured to each other and move together as the player moves his arm upwardly and downwardly.

The player arm support subassembly generally indicated at 33 also includes a means for preventing the player's elbow and forearm from "cocking"—i.e., going back too far. For this purpose, player arm support subassembly 33 is provided with a vertical standard member 37 which is upstanding from the upper surface of pivot stud 36 as best seen in the view of FIG. 3, with the lower end of standard 37 being in screw-threaded engagement with pivot stud 36. A collar member 38 made of metal or other suitable material is adjustably mounted on standard 37 and is held in a given adjusted position at a predetermined desired vertical height on standard 37 by means of a set screw 42 which engages a threaded passage in collar 38 and is engageable with the outer surface of standard 37 whereby to hold collar 38 in the desired adjusted vertical position on standard 37. A normally horizontal rod 40 is suitably secured to collar 38 on a portion of collar 38 which faces away from guide bar 22 and carriage 27. Rod 40 is suitably secured, as for example, by a screw-threaded engagement, with collar 38. A sleeve member 41 made of a suitable material such as rubber or the like is received on rod 40 to provide a cushioning effect for the comfort of the player's arm, since the player's arm bears against the surface of sleeve 41 when the player's arm is in its limiting position in which sleeve 41 serves as a stop to prevent further rearward movement of the player's elbow and forearm beyond the vertical position of the elbow and forearm shown in FIGS. 1 and 2.

A bracing arrangement generally indicated at 43 is provided and provides a bracing collection between guide bar 22 and vest 11 worn by the player.

Figure 3A:
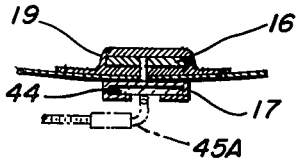
FIG. 3A is a section taken along line 3—3 of FIG. 3.

Cooperating with the bracing arrangement 43 is what might be termed a "receptacle" indicated at 17. Two receptacles 17 are shown in FIG. 3, one on each of the opposite sides of vest 11. Each receptacle 17 as best seen in the view of FIG. 3A is a channel-like member having a generally U-shaped contour which is suitably secured to the intermediate portion of the height of a corresponding one of the vest right and left front panels 11A, 11B. For example, each receptacle 17 may be supported by a corresponding pocket-like portion 19 or 20 carried by the inner surface of the corresponding vest front panel 11A or 11B. Each receptacle 17 may be secured to a corresponding mounting member 16 which lies within the corresponding pocket 19 or 20 which lies on the inner surface of vest front panel 11A or 11B. Receptacle 17 itself is so mounted that it lies on the outer surface of the corresponding vest front panel 11A or 11B, while at the same time being connected to a corresponding base member 16 which lies within the inwardly located pocket 19 or 20. The receptacle 17 is adapted to receive the base or terminal portion 44 which is at the vest end of the bracing subassembly generally indicated at 43, as will be described more fully hereinafter. The slot 18 in receptacle 17 facilitates the insertion or removal of brace terminal portion 44 relative to receptacle 17.

It is assumed for purposes of describing shot developer 10 that the vest is arranged so that it can be used by either a right-hand player or by a left-hand player, in which case two pockets 19 and 20 are provided, each receiving a corresponding receptacle 17, as just described. On the other hand, if it is known that a given vest 11 is to be used only by a right-hand player then only pocket 20 in left-hand front vest panel 11B, with corresponding receptacle 17 need be provided. Conversely, if it is known that a given vest 11 is to be used only by a left-hand player then only pocket 19 in the right-hand front vest panel 11A, with corresponding receptacle 17, need be provided.

In the embodiment illustrated in FIG. 3, guide bar 22 is mounted on pivot stud 13 of right-hand vest panel 11A, since the arrangement of the various elements in FIG. 3 is based on the assumption that the player using the shot developer 10 is a right-handed player.

Where the components of shot developer assembly 10 are arranged for use by a right-hand player as illustrated in FIG. 3, the base portion 44 which is the terminal end at the vest end of brace subassembly 43 is detachably mounted in a receptacle 17 of the left-hand vest front panel 11B as shown in the view of FIG. 3.

Conversely, if the various elements of the shot developer assembly 10 shown in FIG. 3 are for use by a left-handed player, guide bar 22 is mounted on pivot stud 13 of left-hand vest panel 11B and the base portion 44 which is at the vest end of brace assembly 43 is detachably positioned in the receptacle 17 carried by right-hand vest panel 11A. In other words, the base of terminal member 44 at the vest end of the brace subassembly is always received in a receptacle 17 carried by the opposite vest panel than that to which guide bar 22 is attached.

In describing brace subassembly 43, the description will describe the various elements thereof starting at the vest end of the brace subassembly. Thus, as has already been described, at the vest end of brace subassembly 43, base member 44 is provided which is received in the receptacle 17 carried by the appropriate panel 11A or 11B of Vest 11. Brace subassembly comprises an angled sleeve member 45 having an element 45A which is screwed into or otherwise suitably attached to base member 44. The angled sleeve 45 also includes an element 45B which may lie at right angles to element 45A. Elements 45A and 45B of angled sleeve 45 may be angularly adjustable with respect to each other. Element 45B of angled sleeve 45 is secured to a short length of threaded rod 47A which is threadedly engaged with one end of a first turnbuckle 49. A second threaded rod 47B is threadedly engaged with the opposite end of turnbuckle 49 in FIG. 3. A second turnbuckle generally indicated at 50 is provided which engages the left-hand end (as viewed in FIG. 3) of threaded rod portion 47B. Turnbuckle 50 also engages the right-hand end of a threaded rod 51. The opposite or left-hand end of threaded 51 (with respect to the view shown in FIG. 3) is connected to portion 52B of an angled sleeve generally indicated at 52. The opposite portion 52A of angled sleeve 52 is connected to a threaded rod 53, the left-hand end of which relative to the view of FIG. 3 is secured to an intermediate point of the arcuate length of guide bar 22. Thus, brace assembly 43 just described, including the turnbuckles 49 and 50 and the angled sleeves 45 and 52 and the various threaded rod portions 47A, 47B, 51 and 53, provide a means of bracingly connecting guide bar 22 to the base member 44 at the vest end of brace assembly 43, with base member 44 in turn being detachably received in the appropriate receptacle 17 of either the right-hand vest front panel 11A or in the left-hand vest front panel 11B, depending upon whether brace bar 22 is used by a left-hand player or by a right-hand player. Turnbuckles 49 and 50 permit adjustment of the length of bracing subassembly 43.

Figure 4:
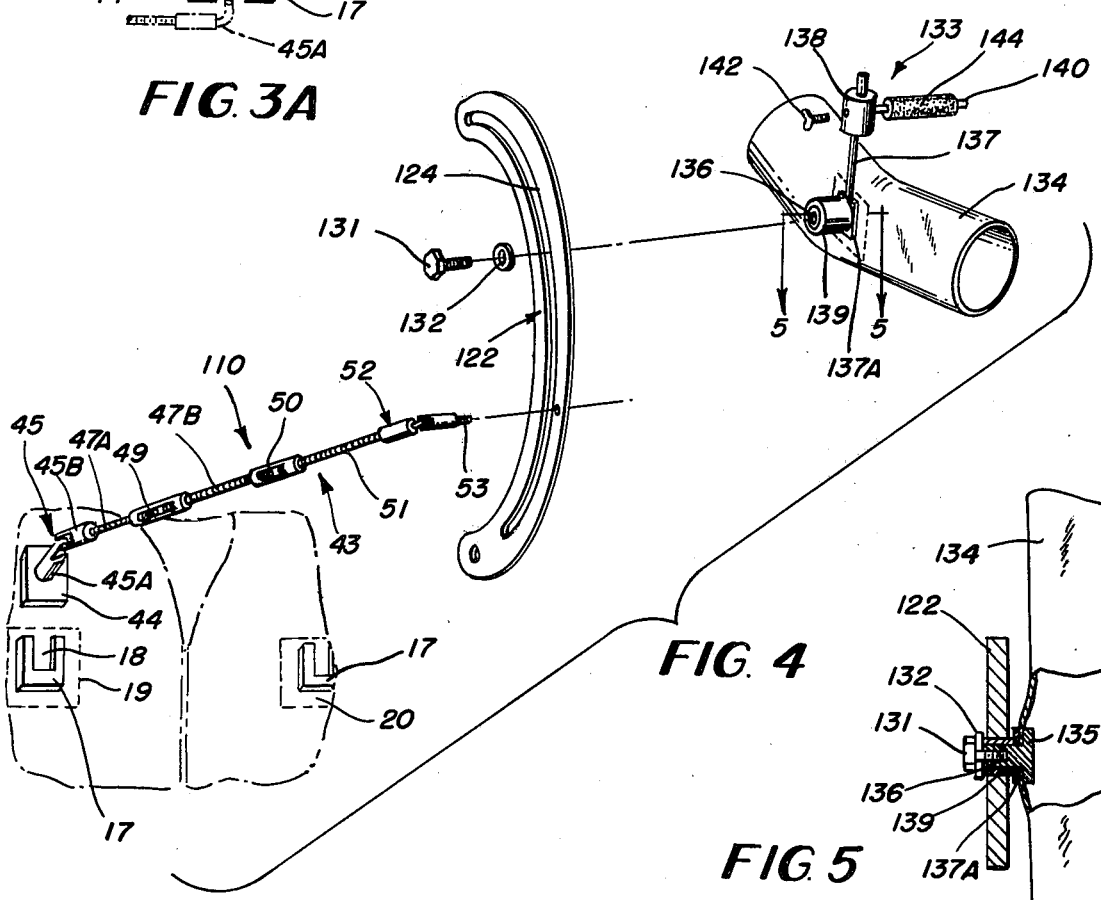
FIG. 4 is a view of a modified embodiment of the shot developer device and showing the elements of the device positioned for use by a left-handed basketball player.

There is shown in FIG. 4 a modified shot developer assembly generally indicated at 110 which operates on the same general principle as the previously described embodiment and which will not be described in detail except to point out the differences between the embodiment of FIG. 4 and the embodiment of FIG. 3.

The modified embodiment of FIG. 4 comprises an arcuate guide bar 122 which is generally similar to the guide bar 22 of the embodiment of FIG. 3 and is adapted to be pivotally mounted contiguous the lower end thereof to a pivot stud similar to the pivot stud 13 of the embodiment of FIG. 3. However, guide bar 122 of FIG. 4 is provided substantially centrally of its radial dimension with an elongated slot or guide track 124 which extends for the greater part of the arcuate length of guide bar 122.

Guide bar 122 in the embodiment of FIG. 4 cooperates with a player arm support subassembly generally indicated at 133 which is generally similar to the player arm support assembly 33 of the embodiment of FIG. 3 and includes a sleeve member 134 of elastic material adapted to be positioned on the player's arm in the same manner as in the embodiment of FIG. 3. The sleeve member 134, as in the previously described embodiment of FIG. 3, includes means for preventing the player's elbow and forearm from "cocking"—i.e., going back too far. For this purpose, the player's arm support subassembly 133 comprises a cylindrical stud member 136 which is supported by a base member 135 supported interiorly of sleeve 134. A vertical standard 137 is suitably secured to stud member 136. Standard 137 carries a vertically adjustable collar member 138 which is held in a desired vertical adjusted position on standard 137 by a set screw 142, and collar 138 supports a rod member 140 which carries a cushioning sleeve 141, and set screw 142 are all respectively similar to the elements 37, 38, 40, 41 and 42 of the previously described embodiment of FIG. 3.

In the modified embodiment of FIG. 4, in place of the carriage 27 of FIG. 3, a roller 139 is positioned on the outer cylindrical surface of stud 136, and the stud 136 with sleeve 139 thereon is received in sliding engagement with the arcuate slot 124 of arcuate guide bar 122.

A headed screw 131 which receives a washer 132 thereon engages a threaded passage in stud 136. The diameter of washer 132 is larger than the passage through arcuate slot 124, whereby cylindrical stud 136 and roller 139 on stud 136, both carried by elastic sleeve 134, are retained in engagement with slot 124 of guide bar 122 whereby to retain elastic sleeve 134 worn by the player along a path of movement defined by guide slot or track 124.

DESCRIPTION OF OPERATION

Figure 1:
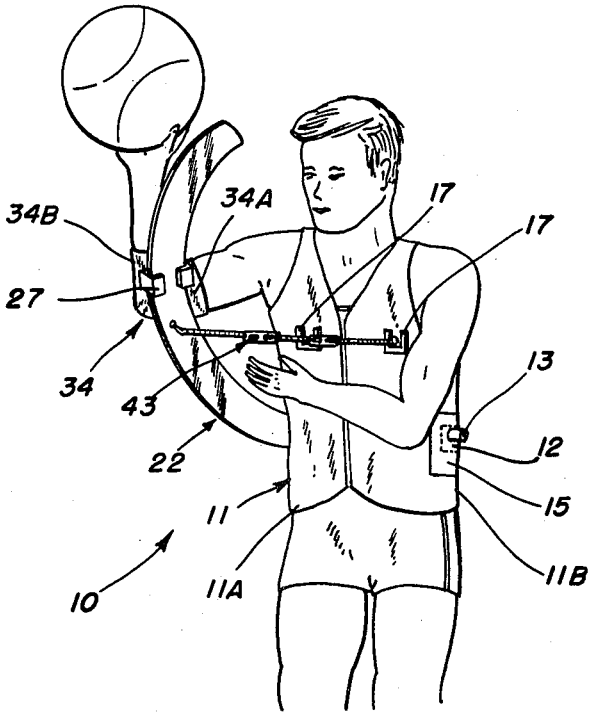
FIG. 1 is a view of a basketball player wearing the shot developer device of the invention and with the arm in shooting position.

In describing the operation, it will be assumed that the training aid is being worn by a basketball player who is right-handed. The operation will be described first in connection with the embodiment of FIG. 3. Vest 11 is worn by the player as seen in FIGS. 1 and 2, and arcuate guide bar 22 is pivotally mounted on pivot pin 13 on vest panel 11A which is at the player's right-hand side. The pivotal mounting of guide bar 22 on pivot stud 13 permits guide bar 22 to pivot about the axis of stud 13 as may be required during the arm motion of the player wearing vest 11 and also permits guide bar 22 to adjust to players having different arm lengths. In the case of a right-handed player, base portion 44 of bracing subassembly 43 is positioned in receptacle 17 of vest panel 11B on the player's left, as best seen in FIGS. 1 and 3.

The player's arm is received in the elastic sleeve 34 which is part of the player arm support assembly 33, sleeve 34 being located in the region of the player's elbow and extending symmetrically a short distance in the arm portions on either side of the elbow. The player's elbow is constrained to move in a path defined by arcuate guide bar 22 since sleeve 34 is connected to carriage 27 which moves along guide track 22. Hence, in moving his arm upwardly to the proper position to project the basketball forwardly, the player's elbow must move in a vertical plane parallel to the vertical plane in which arcuate guide bar 22 lies, this plane also being substantially parallel to the upper trunk portion of the player's body.

As the player raises his arm upwardly, with the arm being guided in its vertical movement by arcuate guide bar 22, the player's forearm should be maintained in a substantially vertical position as seen in FIGS. 1 and 2 with the back surface (as viewed in FIGS. 1 and 2) of the player's arm and/or of the player's wrist bearing against the cushioned sleeve member 41 on rod 40 carried by standard 37, whereby to prevent the player's forearm from "cocking"—i.e., moving too far back. The vertical height of rod 40 and of cushioning sleeve 41 can be adjusted to conform to the requirements of different players. When the player's arm and elbow region reaches the proper height along guide track 22, the player extends his forearm forwardly to project the basketball forwardly with the proper arch or trajectory.

If the player is left-handed, arcuate guide bar 22 is pivotally mounted on pivot stud 13 carried by vest panel 11B on the player's left. Also, if the player is left-handed, the base or terminal portion 44 which is at the vest end of bracing subassembly 43 is positioned in receptacle 17 of vest panel 11A on the player's right.

Figure 5:
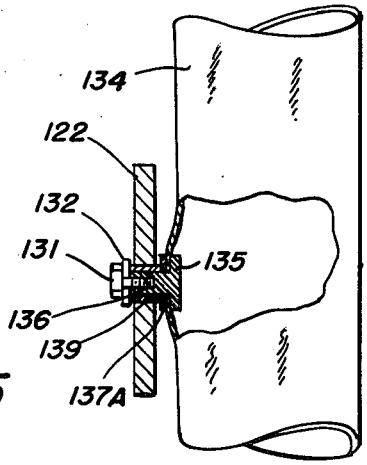
FIG. 5 is a view taken in section along line 5—5 of FIG. 4.

The operation of the modified embodiment of FIGS. 4 and 5 is similar in principle to the operation of the embodiment of FIG. 3 just described, substantially the only difference being that guide sleeve 134 which receives the elbow region of the player's arm is guided in its movement along guide bar 122 by the engagement of roller 139 with the elongated slot 124 in guide bar 122.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. A training aid for use by basketball players, comprising a vest-like member adapted to be worn by the player, an arcuate guide bar for guiding the elbow region of the player's arm for movement in a substantially vertical plane, support means carried by said vest-like member for supporting said guide bar for pivotal movement in a substantially vertical plane about an axis located contiguous the normally lower end of said guide bar, said guide bar being pivotally mounted on said support means, a sleeve member adapted to be worn by the player contiguous the elbow region of the player, and means connected to said sleeve member and slidably engageable with said guide bar, whereby to constrain said sleeve member to move in a substantially vertical path of movement substantially parallel to the plane of said guide bar.

2. A training aid for use by basketball players as defined in claim 1 in which said means connected to said sleeve member is a carriage which slidably engages said guide bar.

3. A training aid for use by basketball players as defined in claim 1 in which said guide bar is provided with an arcuate slot extending for a substantial portion of the arcuate length of said guide bar, and in which said means connected to said sleeve member is a roller-like member which rides in said arcuate slot.

4. A training aid for use by basketball players as defined in claim 1 in which said guide bar is adapted for use by either a right-hand player or by a left-hand player, and in which said vest-like member comprises a first and second support means mounted on opposite sides of said vest-like member respectively on the player's right and on the player's left, said guide bar being adapted to be mounted for pivotal movement selectively on either said first or on said second support means depending on whether said player is right-handed or left-handed.

5. A training aid for use by basketball players as defined in claim 1 comprising a restraining means carried by said sleeve member and positioned at a level above said sleeve member, said restraining means being adapted to be engaged by the forearm and/or the wrist of the player to limit the rearward movement of the player's forearm and/or wrist relative to the player's upper arm portion.

6. A training aid for use by basketball players as defined in claim 5 in which said restraining means comprises a standard member carried by said sleeve member and extending substantially vertically from said sleeve member, and a restraining element mounted on said standard member and normally extending substantially horizontally from said standard member, said retraining element being adapted to be engaged by said forearm and/or said wrist of the player.

7. A training aid for basketball players as defined in claim 6 in which the height of said restraining element is adjustable.

8. A training aid for use by basketball players as defined in claim 1 comprising a bracing means connecting said guide bar to said vest-like member, said bracing means comprising a linkage connected at one end thereof to said guide bar at a point intermediate of the length of said guide bar, and means detachably connecting the opposite end of said linkage to said vest-like member.

9. A training aid for use by basketball players as defined in claim 8 comprising a receptacle member mounted on said vest-like member, and a terminal element carried by said bracing means and easily detachably engageable with said receptacle member whereby to detachably connect said bracing means to said vest-like member.

10. A training aid for use by basketball players as defined in claim 9 in which said receptacle member is mounted on an opposite side of the front of said vest-like member from the saide of said vest-like member on which said guide bar is mounted.

11. A training aid for use by basketball players as defined in claim 10 in which a separate receptacle is mounted on each of the opposite sides of the front of said vest-like member, whereby said terminal element carried by said bracing means may be selectively engaged with either one of said receptacles, depending upon whether said guide bar is mounted for use by a right-hand player or by a left-hand player.

12. A training aid for use by basketball players as defined in claim 8 in which the length of the linkage of said bracing means is adjustable.

13. A training aid for use by basketball players, comprising a vest-like member adapted to be worn by the player, an arcuate guide bar for guiding the elbow region of the player's arm for movement in a substantially vertical plane, support means carried by said vest-like member for supporting said guide bar for pivotal movement in a substantially vertical plane about an axis located contiguous the normally lower end of said guide bar, said guide bar being pivotally mounted on said support means, a sleeve member adapted to be worn by the player contiguous the elbow region of the player, means connected to said sleeve member and slidably engageable with said guide bar, whereby to constrain said sleeve member to move in a substantially vertical path of movement substantially parallel to the plane of said guide bar, a restraining means carried by said sleeve member and positioned at a level above said sleeve member, said restraining means being adapted to be engaged by the forearm and/or the wrist of the player to limit the rearward movement of the player's forearm and/or wrist relative to the player's upper arm portion, a bracing means connecting said guide bar to said vest-like member, said bracing means comprising a linkage connected at one end thereof to said guide bar at a point intermediate the length of said guide bar, and means detachably connecting the opposite end of said linkage to said vest member.

14. A training aid for use by basketball players as defined in claim 13 in which said guide bar is adapted for use by either a right-hand player or by a left-hand player, and in which said vest-like member comprises a first and a second support means mounted on opposite sides of said vest-like member respectively on the player's right and on the player's left, said guide bar being adapted to be mounted for pivotal movement selectively on either side first or on said second support means depending on whether said player is right-handed or left-handed.

15. A training aid for use by basketball players as defined in claim 13 in which said means connected to said sleeve member is a carriage which slidably engages said guide bar.

16. A training aid for use by basketball players as defined in claim 13 in which said guide bar is provided with an arcuate slot extending for a substantial portion of the arcuate length of said guide bar, and in which said means connected to said sleeve member is a roller-like member which rides in said arcuate slot.

17. A training aid for use by basketball players as defined in claim 13 comprising a receptacle member mounted on said vest-like member, and a terminal element carried by said bracing means and easily detachably engageable with said receptacle member whereby to detachably connect said bracing means to said vest-like member.

18. A training aid for use by basketball players as defined in claim 13 in which said receptacle member is mounted on an opposite side of the front of said vest-like member from the side of said vest-like member on which said guide bar is mounted.

19. A training aid for basketball players as defined in claim 13 in which the height of said restraining element is adjustable.

20. A training aid for basketball players as defined in claim 13 in which the length of the linkage of said bracing means is adjustable.

* * * * *